United States Patent [19]

Vujovich

[11] Patent Number: 4,850,512

[45] **Date of Patent: * Jul. 25, 1989**

[54] BLADE HOLDER AND AUTOMATIC DISPENSER

[75] Inventor: Nick Vujovich, Devon, Pa.

[73] Assignee: Le-Jo Enterprises, Inc., Malvern, Pa.

[ * ] Notice: The portion of the term of this patent subsequent to May 2, 2006 has been disclaimed.

[21] Appl. No.: 50,067

[22] Filed: May 13, 1987

[51] Int. Cl.[4] ..... B65H 1/08

[52] U.S. Cl. ..... 221/232; 221/228; 221/279; 206/355; 206/359

[58] Field of Search ..... 221/232, 228, 226, 280, 221/58, 59, 56, 45, 271, 52, 57, 198, 276, 279, 244; 222/392, 391, 386, 256; 312/61, 71; 211/59.3; 267/69, 73, 74; 206/352, 354, 355, 356, 357, 358, 349, 359, 360

[56] References Cited

U.S. PATENT DOCUMENTS

| | | | |
|---|---|---|---|
| 489,069 | 1/1893 | Crook | 221/232 |
| 1,218,196 | 3/1917 | McCorkindale | 221/58 X |
| 1,593,532 | 7/1926 | Hansen | 221/58 X |
| 1,791,586 | 2/1931 | Todd | 221/232 X |
| 2,641,358 | 6/1953 | Santo | 221/232 |
| 3,071,290 | 1/1963 | Taylor | 221/59 |
| 3,202,316 | 8/1965 | Silver | 221/59 |
| 3,650,433 | 3/1972 | Robertson | 221/65 |
| 4,379,514 | 4/1983 | Joffe | 222/279 |

*Primary Examiner*—H. Grant Skaggs
*Assistant Examiner*—Steven B. Parker
*Attorney, Agent, or Firm*—Benasutti & Murray

[57] ABSTRACT

A holder and dispenser for knife blades which includes a sliding partition biased toward a discharge opening by rubber bands in a double loop configuration. The double looped configuration orients the rubber bands which loop around the back of the holder, and loop adjacent the front of the holder and loop around the back of the sliding partition. The rubber bands are oriented in slots or grooves in the holder and dispenser for protection. The sliding partition bias blades held in the holder toward a discharge slot through which blades are slid laterally.

17 Claims, 3 Drawing Sheets

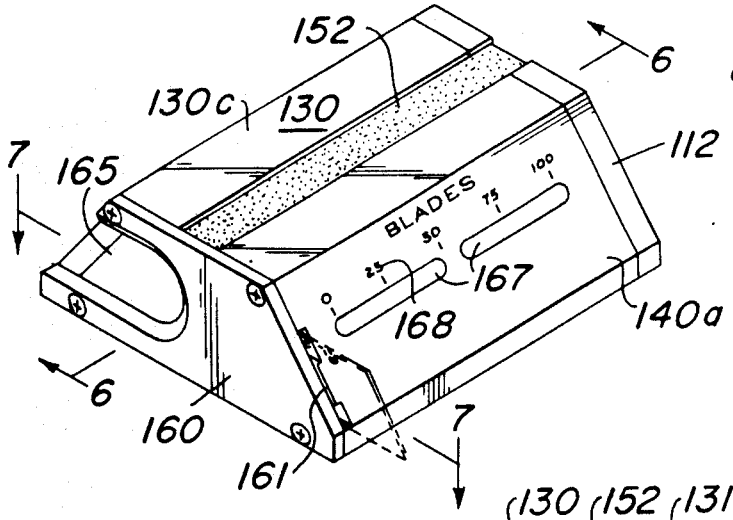
FIG. 5
FIG. 6
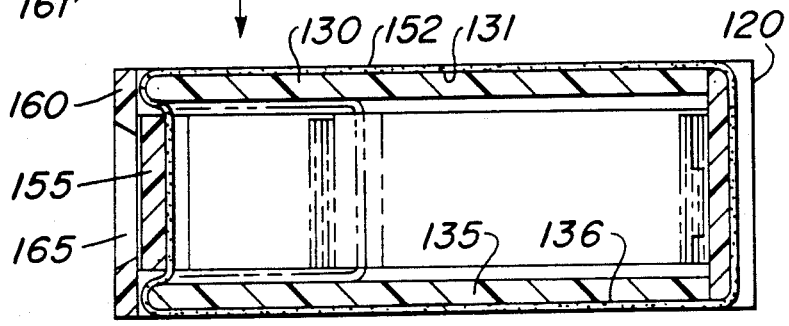
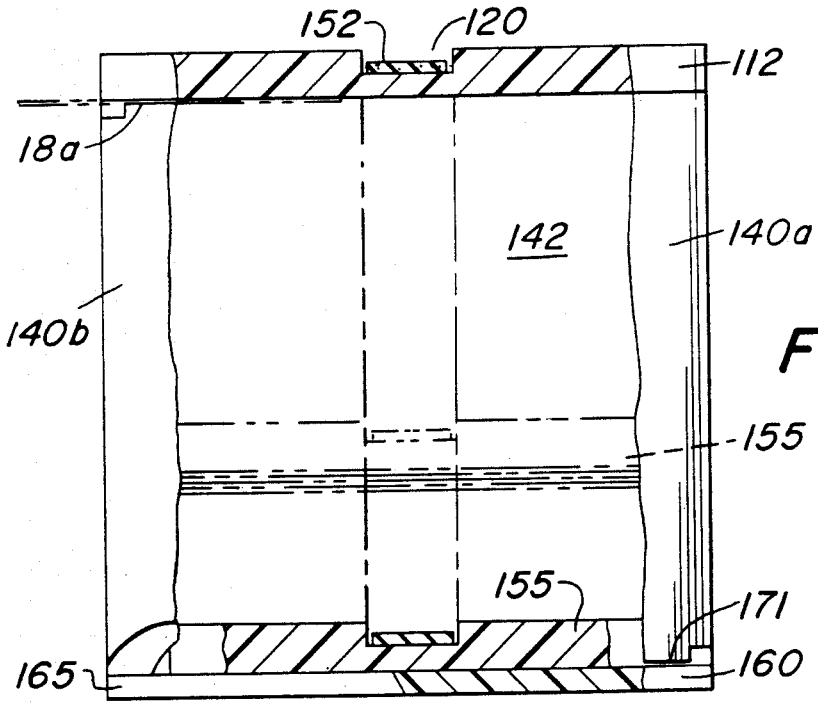
FIG. 7

BLADE HOLDER AND AUTOMATIC DISPENSER

BACKGROUND OF THE INVENTION

The present invention is directed to a holder and dispenser for blades and more particularly to a utility knife blade holder and dispenser which employs a looped rubber band to bias the blades toward the dispenser opening.

In industry, as well as many household activities such as hobbies and crafts, replaceable blades are employed for a wide variety of tasks. For example, replaceable utility knife blades are used in cutting carpeting, cardboard, dry wall sheets, plastic and other materials. The blades dull quickly and must be replaced often to provide a sharp cutting edge. Replacement blades, having a highly sharpened cutting edge are dangerous to handle. A holder and dispenser which ejects a single blade at a time is desirable to both protect the edge on the blades and minimize handling of the blades. A typical utility knife blade is a metal, trapezoidal shaped blade with the longest edge the cutting edge and including notches on the shorter back of the blade. Other blade configurations such as single-edged razor blades and utility blades with a hook-shaped cutting edge are known.

Holders and dispensers for such blades are known. For example, U.S. Pat. Nos. 3,827,597 and 3,542,245 disclose utility knife blade dispensers which use springs to bias the blades toward a dispenser which pivots in the plane of the blades to be dispensed to expose a blade. U.S. Pat. No. 3,650,433 discloses a blade dispenser in which a cover slides over a blade supporting base to hold the blades in a position to be dispensed by sliding through an aperture in the cover. U.S. Pat. No. 4,379,514 discloses a blade holder and dispenser which uses a manual, ratcheting, sliding follower to hold blades in position against a thumb slot which allows blades to be pushed through a dispensing opening. U.S. Pat. Nos. 3,767,083; 2,641,358 and 1,908,115 disclose holders for razor blades which include springs to bias the blades toward a dispensing opening through which the blades are pushed.

It is an object of the present invention to provide a blade holder and dispenser which employs a rubber band to bias blades toward a dispensing opening.

It is a further object of the present invention to provide a blade holder and dispenser which employs a rubber band formed into a double loop configuration to bias blades toward a dispensing opening.

It is a further object of the present invention to provide a blade holder and dispenser which orients a double looped rubber band in slots to protect the looped rubber band from the cutting edge of the blades to be dispensed.

SUMMARY OF THE INVENTION

The present invention includes a holder for blades having a dispensing opening through which a single blade can be ejected by either a sliding ejector or manual manipulation through a thumb slot. The blades within the holder are aligned with a sliding partition which is biased toward the dispensing opening. The sliding partition is biased by an elastomeric member which is looped around the back of the holder and also around the back of the sliding partition. Thus, the biasing forces are applied to the sliding partition at multiple points or over an area of the sliding partition. This allows the sliding partition to be self or automatically adjusted or oriented in the holder due to the self-adjusting or equalizing biasing force applied by the elastomeric member. The holder and sliding partition include slots or grooves into which the elastomeric member fits to protect the member from the sharp edges of the blades.

BRIEF DESCRIPTION OF THE DRAWING

FIG. 5 is an isometric view of an alternate embodiment of my present invention.

FIG. 6 is a cross-section taken along line 6—6 of FIG. 5.

FIG. 7 is a cross-section taken along line 7—7 of FIG. 5.

DETAILED DESCRIPTION OF THE PREFERRED EMBODIMENT

Figure 1:
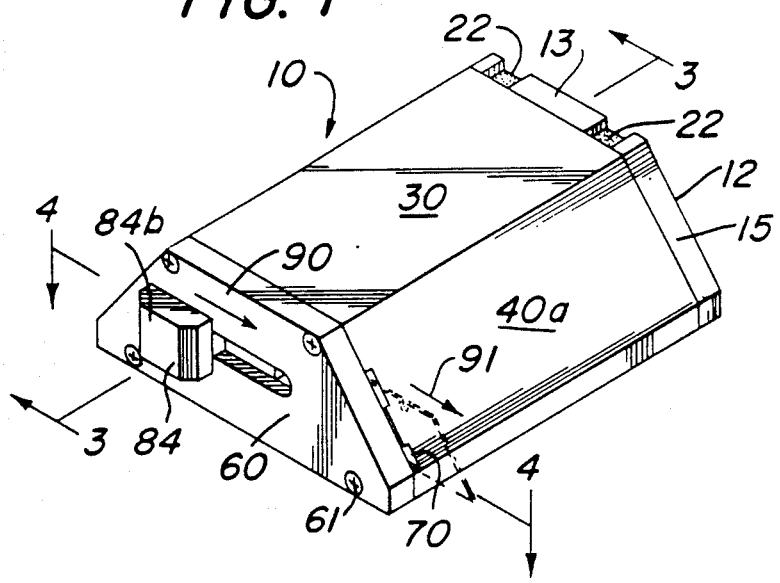
FIG. 1 is an isometric view of my present invention.

With reference to the drawings, a preferred embodiment of my present invention is shown in FIGS. 1 through 4. The blade holder and dispenser is designated generally 10 and is adapted for holding and dispensing trapezoidal utility blades. The blade holder and dispenser includes a rear wall 12. Rear wall 12 is of a trapezoidal configuration having a top 13, a bottom 14 and sloping sides 15 and 16. Rear wall 12 has formed on a surface 12*a* thereof two parallel slots 18 and 20. Slots 18 and 20 extend from the top 13 to bottom 14. Slots 18 and 20 terminate at notches 22 which extend from slots 18 and 20 to surface 12*b* of rear wall 12. Extending substantially perpendicularly from rear wall 12 are top 30, bottom 40 and sides 40*a* and 40*b*. The rear wall 12, top 30, bottom 35 and sides 40*a* and 40*b* define a cavity 42 having the general cross-sectional shape and dimensions of the blade to be dispensed, in the drawings a trapezoid. Alternatively, one of the sides 40*a* or 40*b* may include sight openings to allow the user to see how many blades are held in the holder.

Oriented on the interior surface 30*a* of top 30 are parallel grooves 31. The grooves 31 are oriented so as to align with slots 18 and 20 and notches 22 of rear wall 12. Grooves 31 extend longitudinally for the length of top 30. Oriented on the interior surface 35*a* of bottom 35 are parallel grooves 36. The grooves 36 are oriented so as to align with slots 18 and 20 and notches 22 of rear wall 12. Grooves 36 extend longitudinally for the length of bottom 35.

Figure 2:
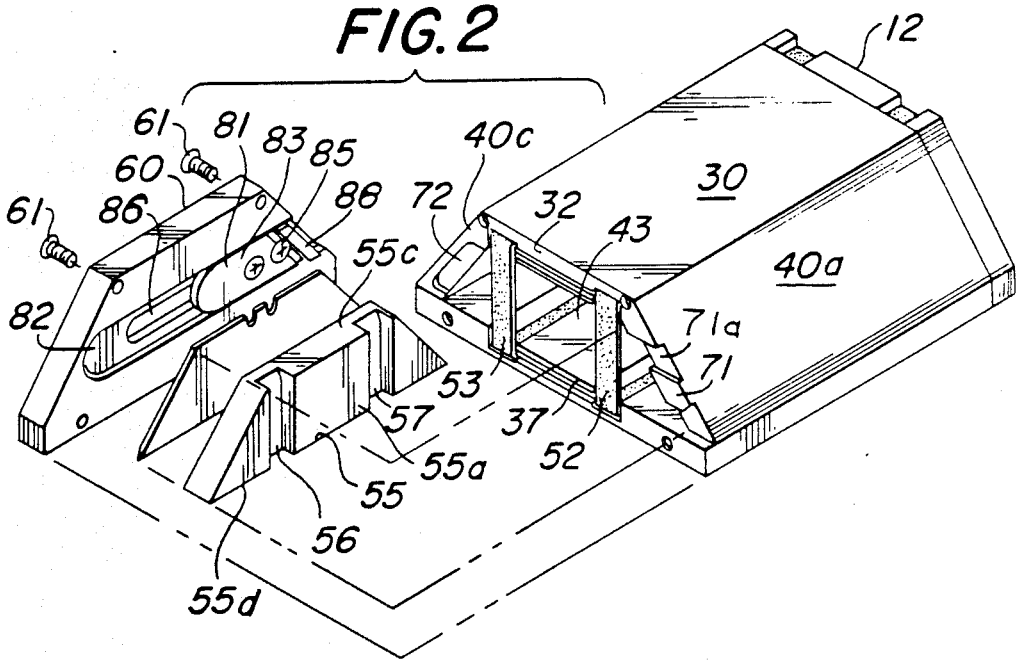
FIG. 2 is an exploded isometric view of my present invention.
Figure 3:
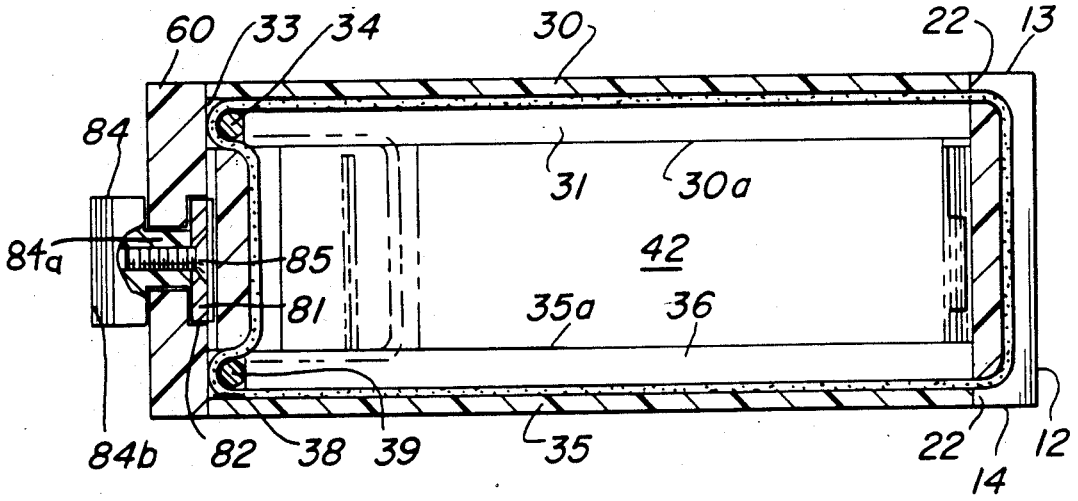
FIG. 3 is a cross-section taken along line 3—3 of FIG. 1.
Figure 4:
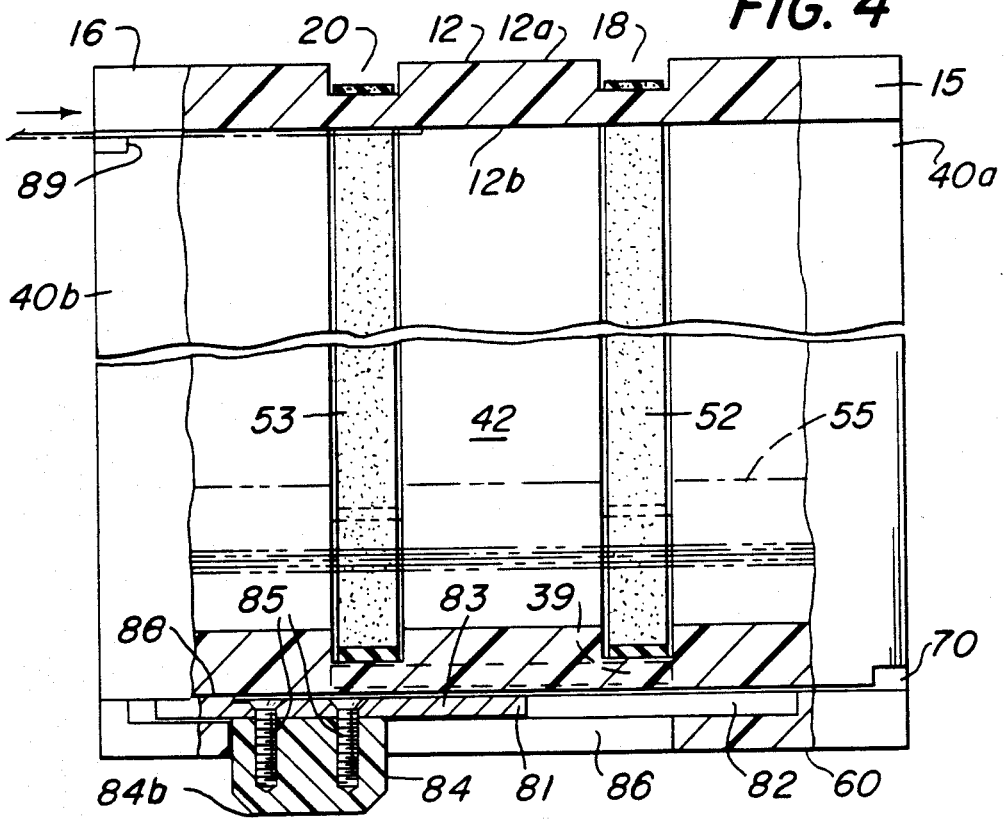
FIG. 4 is a cross-section taken along line 4—4 of FIG. 1.

On the front end 32 of top 30, extending between grooves 31 is a hollow 33 adapted to receive a first roller 34 which extends between grooves 31. The front end 37 of bottom 35, includes a hollow 38 extending between grooves 36, adapted to receive a second roller 39 which extends between groove 36. Top 30, bottom 35 and sides 40*a* and 40*b* forming body 50 may be formed from a single piece as by molding or may be separate elements interconnected by any suitable means such as screws or glue. Rear wall 12 is a separate piece adapted to be affixed to body 50 by any suitable means such as screws or glue. Rear wall 12 is formed as a separate piece to allow segments of rubber bands 52 and 53 to be oriented around rear wall 12 in slots 18 and 20, through notches 22, along grooves 31 and 36 and around rollers 34 and 39 as shown in FIGS. 2, 3 and 4. The rubber bands 52 and 53 are thus looped around rear wall 12 and extend across the front opening 43 of cavity 42.

A sliding partition 55 is provided which fits within cavity 42 and may be of the general cross-sectional shape of the blades to be held in cavity 42. Sliding partition 55 is of a size and shape so that it is free floating within cavity 42, that is there is no interconnection between sliding partition 55 and the walls of cavity 42. Sliding partition 55 includes grooves 56 and 57 on a back surface 55*a* which are adapted to receive segments of rubber bands 52 and 53 when sliding partition 55 is oriented within cavity 42. The rubber bands 52 and 53 are thus formed into loops around rollers 34 and 39 and the back side 55*a* of partition 55. The looped rubber bands 52 and 53 bias partition 55 toward the opening of 43 of cavity 42. The looped rubber bands contact the sliding partition 55 at both the top 55*c* and bottom 55*d* and along grooves 56 and 57 of sliding partition to provide for a multi point or area contact of the biasing force on sliding partition 55. Sliding partition 55 is thus aligned or oriented within cavity 42 by the equalizing or self-adjusting biasing action of rubber bands 52 and 53.

A front cover 60 is provided which is releasably affixed to the front distal ends of top 30, bottom 35 and sides 40*a* and 40*b* to enclose cavity 42. Front cover 60 is fixed by screws 61 or other suitable means. Before front cover 60 is fixed in position, sliding partition 55 is oriented in cavity 42 in contact with rubber bands 52 and 53 and a plurality (typically 100) blades are inserted into cavity 42 so as to force partition 55 toward back wall 12 as shown in phantom in FIGS. 3 and 4. The cover 60 is then fixed in place. The blades held in cavity 42 are thereby biased towards front cover 60 by the looped rubber bands 52 and 53 which bias the sliding partition 55.

Front cover 60 includes an ejector means to slide a single blade out of the holder 10 through dispensing opening 70. Dispensing opening 70 is formed between front cover 60 and a first side 40*a* as by forming a notch 71 in side 40*a*. The notch is of a depth of from about 0.02 to 0.03 inches to allow blades of standard thicknesses of from about 0.012 to 0.025 inches to easily slide between front cover 60 and side 40*a*. Notch 71 can also include openings 71*a* to allow a thicker, reinforced section of a blade, as with the back of single edged razor blade to pass. On the distal end 40*c* of second side 40*b*, a notch 72 is formed to allow ejector 80 described below to fit therein.

Ejector 80 includes a sliding plate 81 oriented in a groove 82 in front cover 60. Sliding plate 81 has a main body portion 83 which fits within groove 82 and is of a thickness slightly less than the depth of groove 42. Plate 81 is held in groove 82 by attachment to knob 84 by screws 85 or other suitable means. A portion 84a of knob 84 having a reduced cross sectional area extends through a slot 86 in front wall 60 which corresponds to groove 82. The exposed portion 84*b* of knob 84 thus can be used to slide plate 81 laterally across front cover 60.

An extending lip 88 of plate 81 is provided to engage one of the blades held in cavity 42, which are biased against front wall 60 by sliding partition 55 and looped rubber bands 52 and 53. As plate 81 is moved laterally, arrow 90, a single blade is engaged by lip 88 and slid laterally, arrow 91, to be ejected through dispensing opening 70. As plate 81 is moved back, lip 88 of plate 81 fits into notch 72 on side 40*b* so that the next blade can be biased against front cover 60 for ejection.

If desired, the holder 10 may also include a notch 89 between second side 40*b* and rear wall 12 to allow used blades to be inserted into cavity 42 behind sliding partition 55, FIG. 4.

With references to FIGS. 5, 6 and 7, an alternate embodiment of my present invention is shown. In the alternate embodiment, a single rubber band 152 is oriented in a groove 120 of back wall 112 and grooves 131 and 136 of top 130 and bottom 135 respectively. The grooves 131 and 136 are on the exterior surfaces 130*c* and 135*c* of top 130 and bottom 135 respectively. The rubber band 152 thus extends across the front opening 143 of cavity 142 from top 130 to bottom 135. A sliding partition 155 having a slot 156 on a rear surface 155*a* is fitted within cavity 142. Rubber band 152 fits within slot 156 so that rubber band 152 is looped behind sliding partition 155 so as to bias sliding partition toward the front cover 160. Front cover 160 includes a thumb slot 165 which allows a blade (shown in phantom in FIGS. 6 and 7) to be pushed laterally through dispensing opening 171. Dispensing opening 171 is formed between side 140*a* and front cover 160.

If desired, side 140*a* may include sight openings 167 and markings 168 so that the number of blades in the holder 110 can be monitored. A slot 189 may be provided between side 140*b* and rear wall 112 to allow used blades to be inserted into cavity 142 behind sliding partition 155 for disposal.

The apparatus of the present invention provides a blade holder and dispenser which uses rubber bands formed into a double loop configuration to bias a sliding partition in a blade holder toward the blade ejection means. The rubber bands are protected by orientation within groove in the body of the holder. The double loop configuration of the rubber bands provides an optimized biasing force which maintains adequate pressure on the blades even as the stack of blades in the holder is depleted. The maintenance of pressure on the blades within the holder and dispenser by the double loop configuration of the rubber bands also prevents the next blade to be dispensed from falling out of the holder and dispenser during handling due to the maintenance of biasing pressure on the stack of blades regardless of the number of blades in the stack. This biasing of the stack of blades in the holder against the front cover of the holder dispenser further allows the use of the holder and dispenser with different blade thicknesses. Because the stack of blades in the holder dispenser is continually biased against the front cover by the double loop configuration of the rubber bands, blades of differing thicknesses can be used in a single holder and dispenser without the next blade to be dispensed falling through the dispensing opening.

Although the foregoing serves well to satisfy the objectives previously set forth, it will be understood that the blade holder and dispenser previously described may be modified in order to be employed with a variety of blade designs. For example, the size and cross-sectional shape of the blade holder and dispenser may be modified so as to be particularly suitable for holding and dispensing rectangularly shaped single edge razor blades, or other blade shapes.

It will therefore be understood that various changes in the details, materials and arrangement of the parts which have been herein described and illustrated in order to explain the nature of this invention, may be made by those skilled in the art within the principal and scope of the invention as expressed in the following claims.

What is claimed is:

1. An improved holder and dispenser for blades having a blade retaining cavity in which blades are biased towards an ejection means adjacent a discharge slot disposed on a front wall of said cavity wherein the improvement comprises:

(a) at least one rubber band which contacts at more than one point, a free-floating sliding partition oriented in the cavity to bias blades toward said ejection means; and (b) said rubber band being oriented around a back of said holder looped adjacent said front wall and looped around a back side of said sliding partition; and (c) all portions of the peripheral surface of said rubber band being maintained free of contact with all other portions of the peripheral surface of said rubber band.

2. The improved holder and dispenser of claim 1, wherein portions of the rubber band are oriented in grooves formed in said holder and in said sliding partition.

3. The improved holder and dispenser of claim 1, wherein said at least one rubber band is looped around rollers set in said holder adjacent said front.

4. The improved holder and dispenser of claim 1, wherein said at least one rubber band comprises two rubber bands.

5. The improved holder and dispenser of claim 1, wherein said ejection means comprises an ejector, slidingly affixed to said front wall of said holder, having a lip extending therefrom to engage a blade held in said cavity, said blade biased toward said ejection means by said at least one rubber band whereby sliding said ejection means forces a blade out of said cavity through said discharge slot.

6. The improved holder and dispenser of claim 1, wherein said ejection means comprises a finger slot in said front wall of said holder which exposes a portion of a blade held in said cavity and biased toward said finger slot by said at least one rubber band, whereby said blade is manually forced out of said cavity through said discharge slot.

7. A holder and dispenser for blades comprising:

(a) a rear wall;

(b) top, bottom and sides extending from said rear wall defining a longitudinal cavity;

(c) a sliding partition adapted to fit within said cavity;

(d) a front cover adapted to be affixed to said top, bottom and sides to seal said cavity, including means to slide blades laterally through a discharge slot; and (e) at least one rubber band is looped around said rear wall extends along said top and bottom, is looped adjacent said front cover, and is looped around a back side of said sliding partition.

8. The holder and dispenser of claim 7, wherein said at least one rubber band extends along grooves on an inside surface of said top and said bottom and is looped around rollers set in said top and said bottom adjacent said front cover.

9. The holder and dispenser of claim 7, wherein said means to dispense blades includes an ejector, slidingly affixed to said front cover having a lip extending therefrom to engage a blade held in said cavity, said blade biased toward said ejector by said at least one rubber band acting on said sliding partition whereby sliding said rubber ejector forces a blade out of said cavity through said discharge slot.

10. The holder and dispenser of claim 7, wherein said means to dispense blades includes a finger slot in said front cover which exposes a portion of a blade held in said cavity and biased toward said finger slot by said sliding partition, whereby said blade is manually forced out of said cavity through said discharge slot.

11. The holder and dispenser of claim 7, employing two substantially parallel rubber bands.

12. The holder and dispenser of claim 7 further including a used blade receiving opening adjacent said rear wall.

13. The holder and dispenser of claim 7 including a sight opening along at least one of said sides.

14. The holder and dispenser of claim 7 having a cross-sectional geometric shape of a trapezoid adapted to hold and dispense utility knife blades.

15. An improved holder and dispenser for blades having a blade retaining cavity in which blades are biased toward an ejection means adjacent a discharge slot wherein the improvement comprises: at least one rubber band which contacts, at more than one point, a free-floating sliding partition oriented in said cavity to provide a self-orienting biasing means to bias blades toward said ejection means wherein said rubber band is arranged in a double loop configuration by orienting said rubber band around a back of said holder, looped adjacent a front of said holder and looped around a backside of said sliding partition.

16. The improved holder and dispenser of claim 15 wherein said at least one rubber band is oriented in grooves in said holder and in said sliding partition.

17. The improved holder and dispenser of claim 15, wherein said rubber band is looped around rollers set in said holder adjacent said front.

* * * * *